US009681754B2

(12) United States Patent
Avery

(10) Patent No.: US 9,681,754 B2
(45) Date of Patent: Jun. 20, 2017

(54) COLLAPSIBLE ROLLING STOOL

(71) Applicant: John Leonard Avery, Colfax, NC (US)

(72) Inventor: John Leonard Avery, Colfax, NC (US)

(73) Assignee: AVERY AEROSPACE CORPORATION, Jupiter, FL (US)

( * ) Notice: Subject to any disclaimer, the term of this patent is extended or adjusted under 35 U.S.C. 154(b) by 86 days.

(21) Appl. No.: 14/792,735

(22) Filed: Jul. 7, 2015

(65) Prior Publication Data

US 2017/0007026 A1 Jan. 12, 2017

(51) Int. Cl.
*A47C 9/02* (2006.01)
*A47C 7/00* (2006.01)
*A47C 9/10* (2006.01)

(52) U.S. Cl.
CPC ..... *A47C 9/02* (2013.01); *A47C 7/006* (2013.01); *A47C 9/105* (2013.01)

(58) Field of Classification Search
CPC ..... A47C 9/105; A47C 4/10; A47C 7/006
USPC ..... 297/16.1, 16.2
See application file for complete search history.

(56) References Cited

U.S. PATENT DOCUMENTS 514,851 A * 2/1894 Hiser ..... A47C 9/105 108/128
816,158 A * 3/1906 Erickson ..... A47C 9/00 108/128
1,166,386 A * 12/1915 Perrin ..... A47C 9/105 248/155.2
1,365,873 A 1/1921 Waterlow
2,759,528 A * 8/1956 Rachman ..... A47C 9/105 108/5
3,038,690 A * 6/1962 Alexiou ..... A47C 4/24 108/128
4,183,579 A * 1/1980 Gonzalez y. Rojas A61B 90/60 248/171
4,934,638 A 6/1990 Davis
5,044,690 A 9/1991 Torrey
6,062,638 A 5/2000 Ferguson
7,588,228 B2 * 9/2009 May ..... G10D 13/026 248/165
7,802,764 B2 * 9/2010 Leinen ..... A61M 5/1415 248/129
9,330,645 B2 * 5/2016 Sawhney ..... G10G 5/00
2002/0195528 A1 * 12/2002 Overbeck ..... A47C 4/20 248/188.6
2003/0020312 A1 * 1/2003 Wang ..... A47C 9/105 297/344.18
2005/0242630 A1 11/2005 Miller
2009/0174233 A1 * 7/2009 Hoffman ..... A47C 4/286 297/16.2
2010/0314926 A1 * 12/2010 Chesness ..... A47C 4/286 297/258.1

* cited by examiner

*Primary Examiner* — Sarah McPartlin

(57) ABSTRACT

The present invention is a collapsible stool with a plurality of legs that can be stored either freestanding or hung, and that has a single handle that is used to carry, initiate expansion or collapse of, or used to guide the stool when sitting. Further, the stool has a novel mechanism that allows a smooth transition from collapse to expansion and expansion to collapse using a single handle. This same mechanism allows the stool to stand upright in a stable position in both the expanded and collapsed configurations.

4 Claims, 14 Drawing Sheets

COLLAPSIBLE ROLLING STOOL

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

Field of Invention

The present invention relates generally to portable stools and, more particularly, to a collapsible office stool with castering wheels that can be carried and operated by a single handle using a person's single hand.

Prior Art

It is often necessary for people to interact with machines or other people on a temporary basis. These interactions occur in office settings constantly throughout the world. The majority of cases when people interact in an office setting, one person is already seated. For the other person to communicate effectively for all but brief periods, a sitting position is optimum, allowing for both relaxed communication and reduced physical effort on the visiting individual. This situation is especially common in office spaces that have been separated by partitions or cubicles, or in doctors' offices.

Temporary seating has been around since tools themselves. A four-legged folding stool was proposed in the early part of the last century. See U.S. Pat. No. 816,158 (Erickson). This stool was designed particularly for camping, used a soft material for the seat, and seemed to require maneuvering of individual parts to erect into a usable device. By 1915 a design was disclosed that collapses a stool into a walking stick. This concept, again, contained a soft seat made of fabric. A reciprocating center rod, combined with straps, synchronized the retraction of four supporting legs. Extending the legs on this design would also require both hands and some maneuvering. See U.S. Pat. No. 1,166,386 (Perrin). By 1919 a stool design was suggested that contained three legs and a more substantial seat than its predecessors. This design required complete assembly and disassembly of individual parts to make it usable or compact. See U.S. Pat. No. 1,365,873 (Waderlow). In 1978, a device was presented to provide doctors a seat while performing long procedures. This stool contained three main legs and two auxiliary outriggers for stability. Its size could be reduced by collapsing the legs and outriggers for transportation. This stool was designed to be stationary as it used suction cups to secure the legs to the floor. See U.S. Pat. No. 4,183,579 (Gonzalez). Yet another collapsible stool design with a cloth seat was presented in 1989. This very simplistic design contained a plurality of poles hinged at about their midpoints with ends connected to a common piece of cloth. No reciprocating motion was used to expand or contract the legs. Again, maneuvering would be required using both hands to get this device into a stable seating configuration. See U.S. Pat. No. 4,934,638 (Davis). In 1990, a chair configuration was disclosed that used two hinge lines and a piece of cloth to create collapsible seat. This design is similar to the common lawn chair and has a limited ability to expand wide enough for a stable seating configuration, yet be compact. See U.S. Pat. No. 5,044,690 (Torrey). A portable stool with a single main telescoping support and a plurality of stabilizing legs was disclosed. This stool is designed specifically for outdoor use where a spring-loaded main support provides shock absorption for a sitting person if they should come in contact with an animal or discharge a firearm while seated. The plurality of legs are manually installed using fasteners at the time of use. See U.S. Pat. No. 6,062,638 (Ferguson). Another outdoor seating design was disclosed in 2005 that uses a single pole extending from a seat to the ground that provides a means supporting one's weight while fishing or other outdoor activity. This design is compact but has no means of providing stability. See US. Pat. No. 2005/0242630 (Miller).

OBJECTS AND ADVANTAGES

The present invention is a rolling stool of stable configuration that collapses and expands by raising or lowering a single handle at the front of its seat using a person's single hand. Further, the invention can be carried by the same handle without the need to use one's other hand at any point.

A normal cycle of use for the present invention is as follows. The stool is hanging on a cubicle partition or door by its storage guide, or standing collapsed in a corner of the room with its handle easily accessed in the vertical position. A person, who may have one hand full, grabs the stool by the handle and picks it up from its stowed location. The stool maintains its collapsed position under the load created internally between the handle and its own weight. The person walks to a location they prefer to sit, carrying the stool like a briefcase. On location, the stool is set on the ground in front of them and gentle downward pressure is applied to the handle to lower it. This causes the stool to unfold its legs to create a stable seating platform. At the same time, the seat rotates from a near vertical to a horizontal position. The stool can then be used to sit and roll around a vicinity on its plurality of casters, using the handle to help guide its motion, which will be between the knees of the sitting person. When someone is done sitting, they can simultaneously dismount the stool, stand, and pick up on the stool's handle. The upward force on the handle will automatically fold the stool into a collapsed position. It is ready to be carried to a desire location and hung or set down on the floor. Only a single hand of the person is needed throughout the whole process, leaving the other hand free to carry business related materials. Since the stool is stable in both collapsed and extended positions, it can be place on any level floor in either position until ready for use. In its collapsed position, the stool can be hung on a cubicle partition, a door, or any other rigid vertical structure. Or, it can stand nicely in the corner of an office without the need to rest against a wall for stability.

Part of the novelty of the present invention is the single handle operation that takes only one hand to expand, collapse and transport the stool. What is not obvious is the unique kinematics of the stool's folding mechanism. A plurality of double-wheeled casters are used to allow translation, while sitting on the stool, but they also work as a component of a smooth folding mechanism. As the stool is placed on the ground, the hinge line of each caster is above the wheels' contact point. If the casters contained single wheels, they would be unstable and flip around at first contact. (Refer to FIGS. 12 through 14) The present invention's novel mechanism allows the stool to smoothly unfold its legs as the casters roll across the floor's surface. The mechanism's geometry and the double-wheels of the casters allow local stability of each caster as they transition into a position with their pivot axis in a vertical orientation as the stool is unfolded. This is one unique feature of this stool that is not obvious at first inspection. This same local stability of each double-wheeled caster allows the stool to sit on the ground in the collapsed configuration without failing over, while a slight downward pressure on the handle causes the seat to go from a near vertical to a horizontal position as the stool unfolds all of its components in complete unison.

SUMMARY OF INVENTION

The present invention is a collapsible stool with a plurality of legs that can be stored either freestanding or hung, that contains a single handle that is used to carry, initiate expansion or collapse of, or used to guide the stool when sitting. Further, the stool has a novel mechanism that allows a smooth transition from collapse to expansion and expansion to collapse using a single handle. This same mechanism allows the stool to stand upright in a stable position in both the expanded and collapsed configurations.

DETAILED DESCRIPTION OF THE PREFERRED EMBODIMENTS

Figure 1:
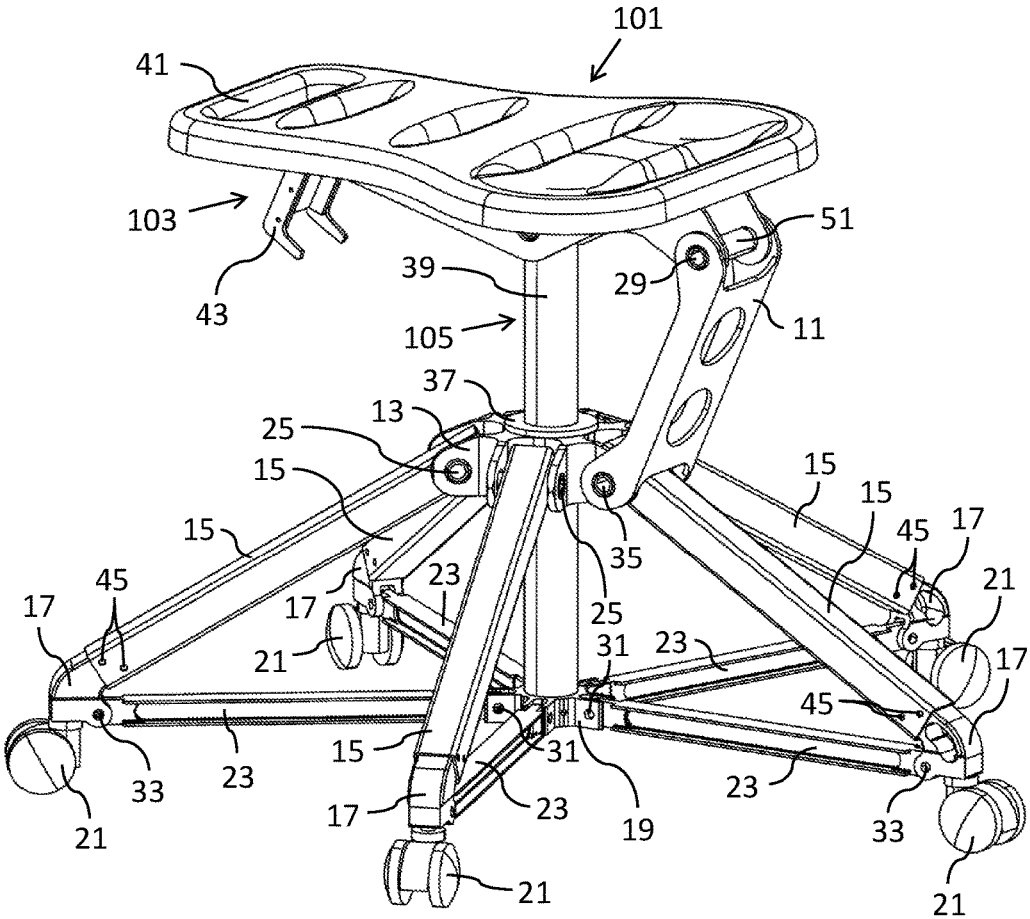
FIG. 1 is a perspective view of the present invention in the expanded position.
Figure 2:
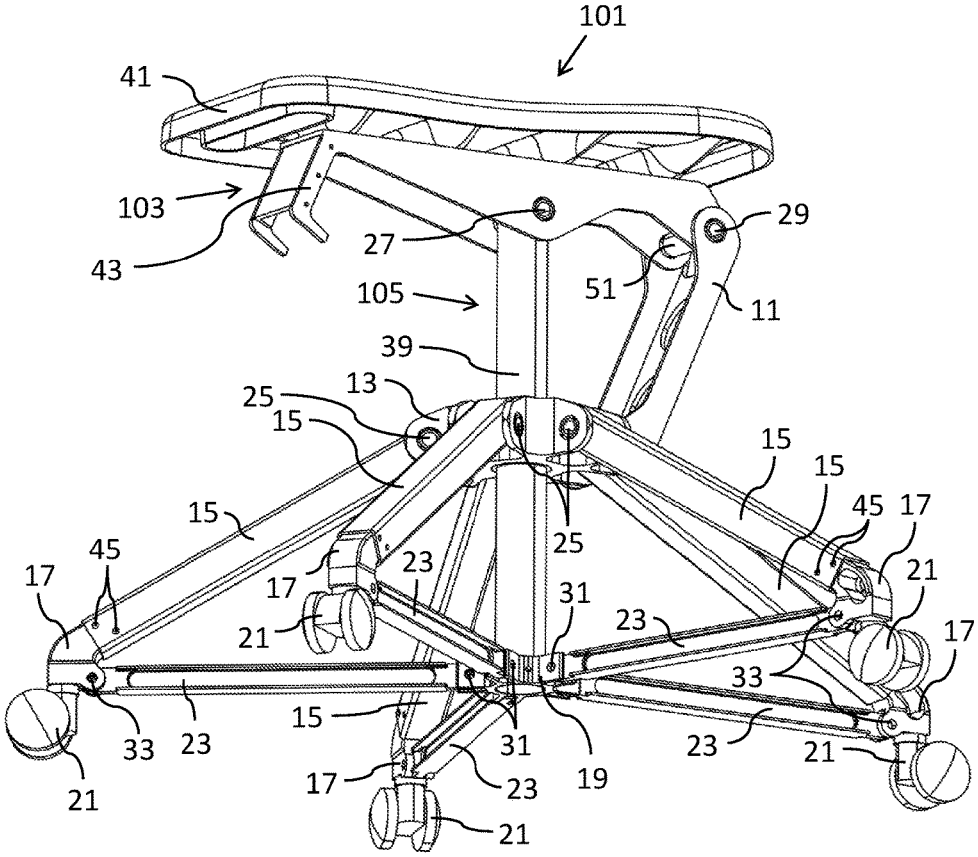
FIG. 2 is a perspective view of the present invention in the expanded position showing the lower side.
Figure 3:
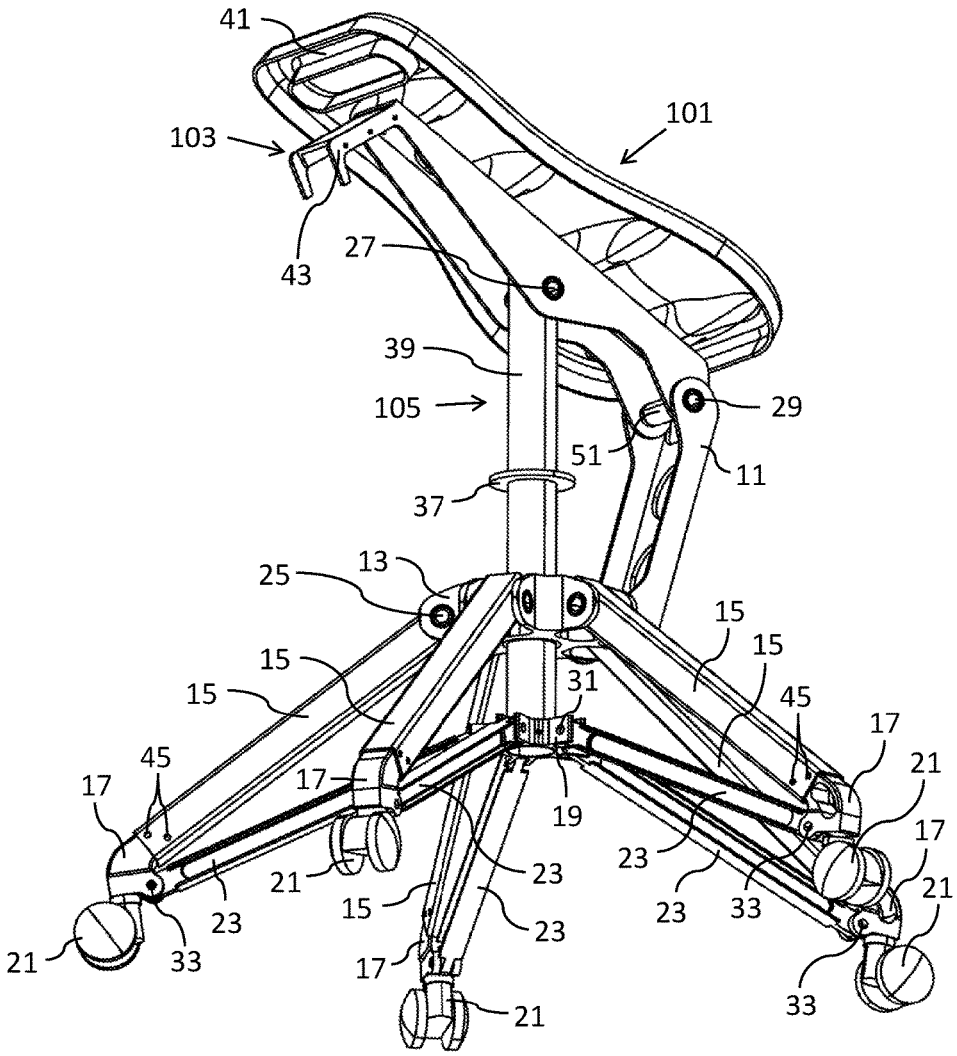
FIG. 3 is a perspective view of the present invention in an intermediate position between expanded and collapsed.
Figure 4:
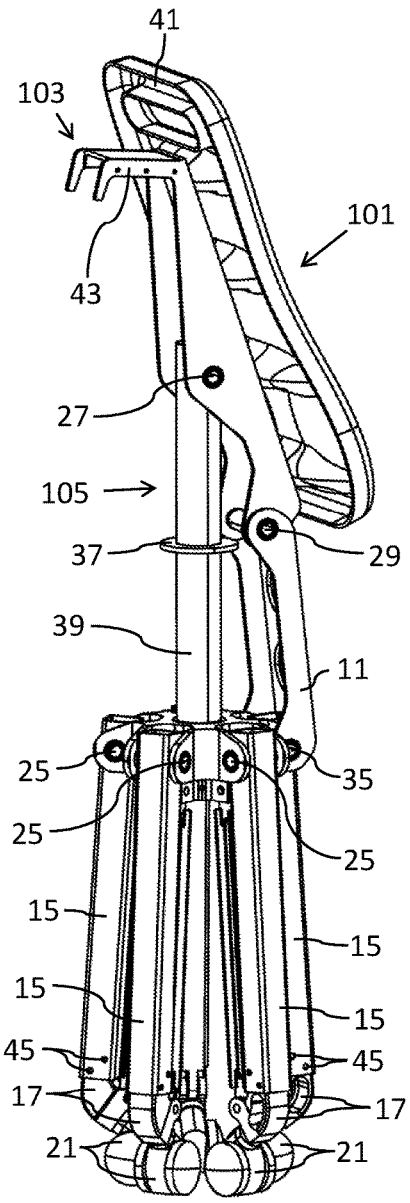
FIG. 4 is a perspective view of the present invention in a collapsed position showing the lower side of the seat.
Figure 5:
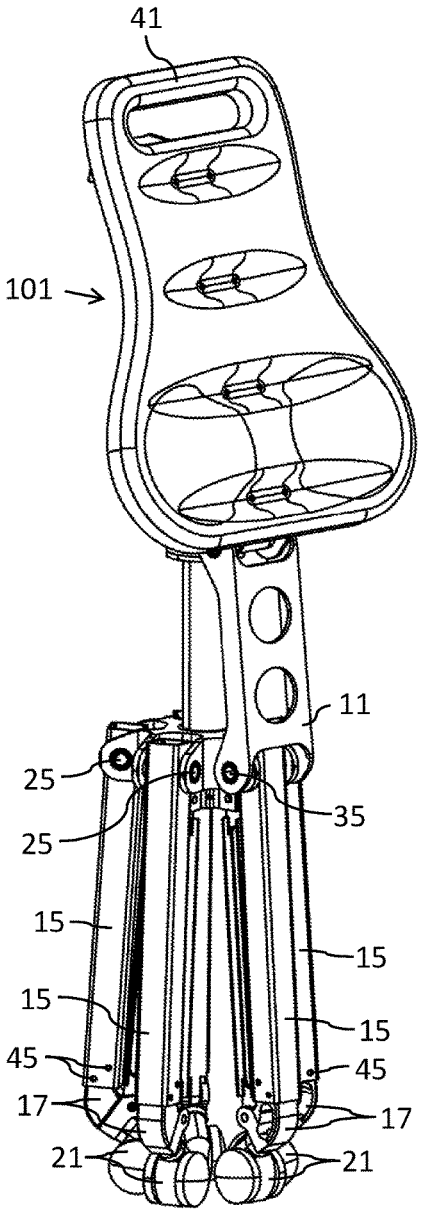
FIG. 5 is a perspective view of the present invention in a collapsed position showing the upper side of the seat.
Figures 6, 7:
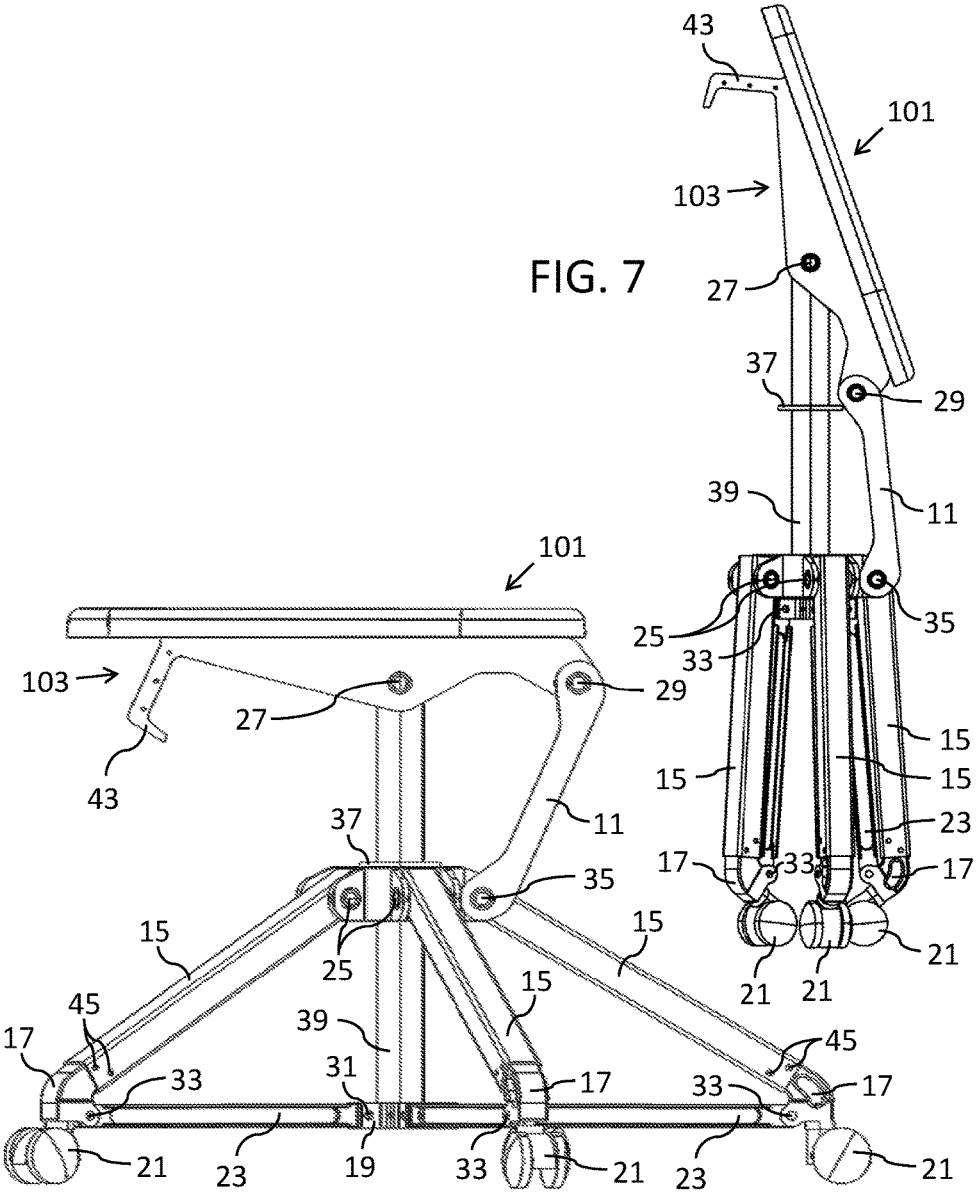
FIG. 6 is a side elevation view of the present invention in an expanded position.
FIG. 7 is a side elevation view of the present invention in a collapsed position.
Figure 8:
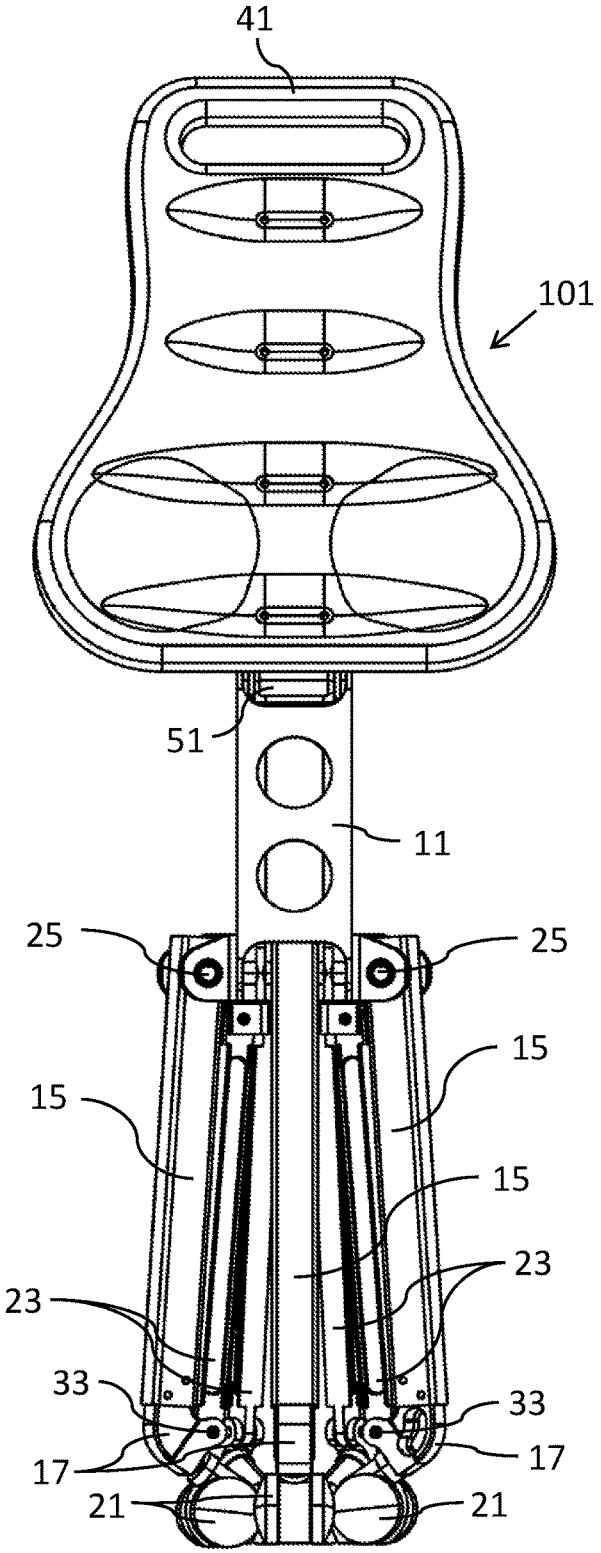
FIG. 8 is a back elevation view of the present invention in a collapsed position.
Figure 9:
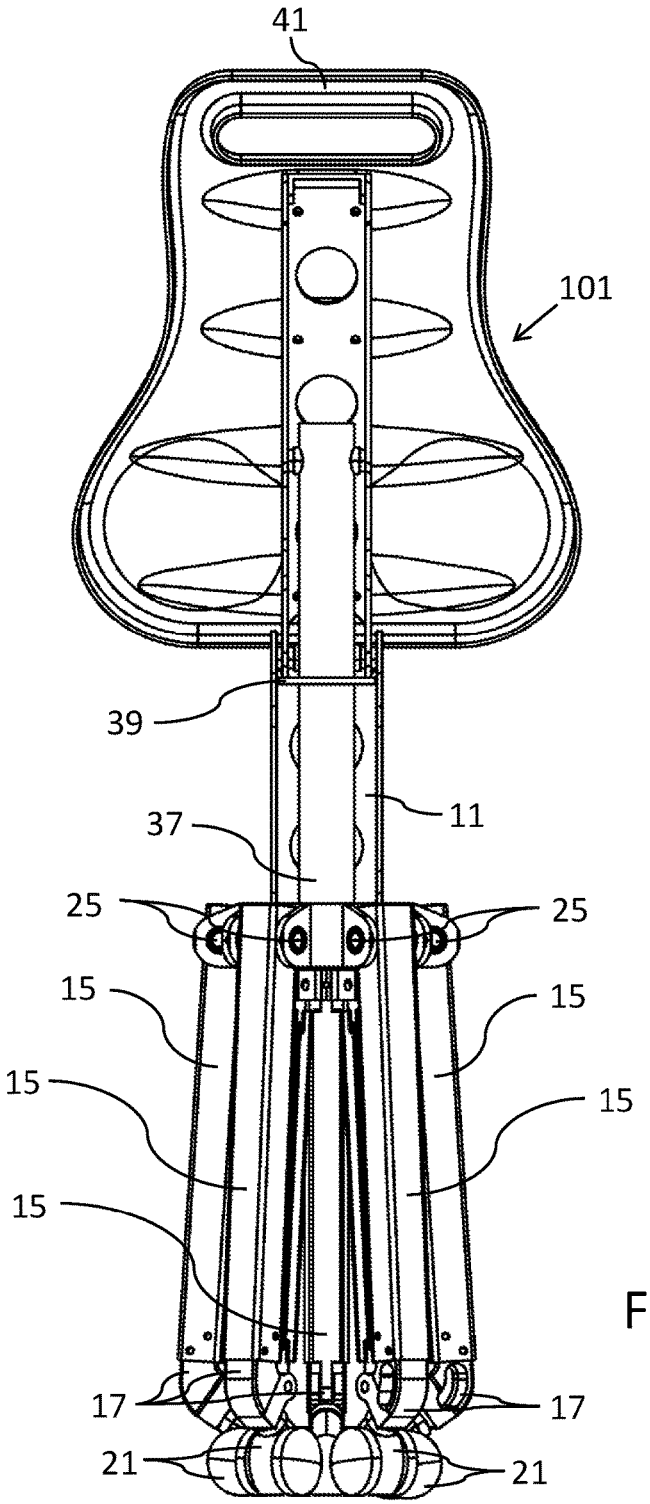
FIG. 9 is a front elevation view of the present invention in a collapsed position.
Figure 10:
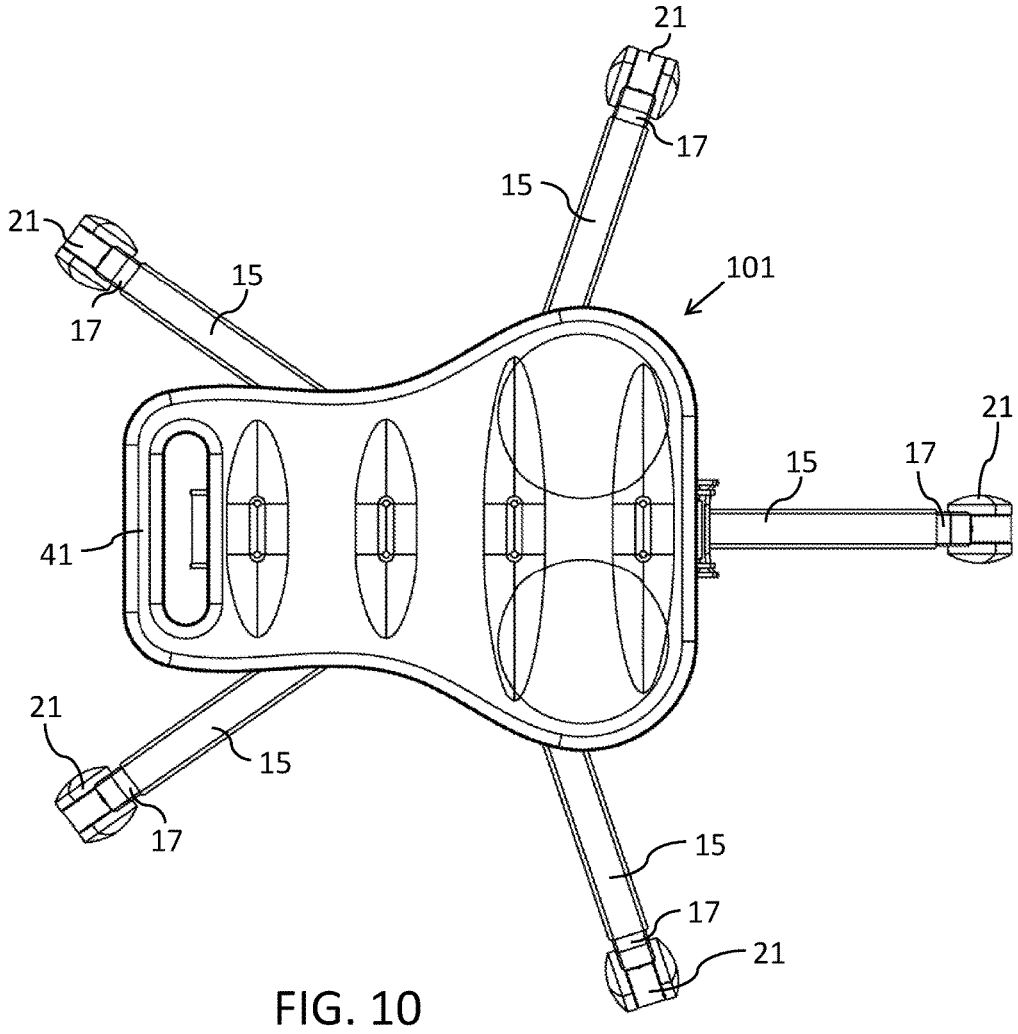
FIG. 10 is a plan view of the present invention in an expanded position.
Figure 11:
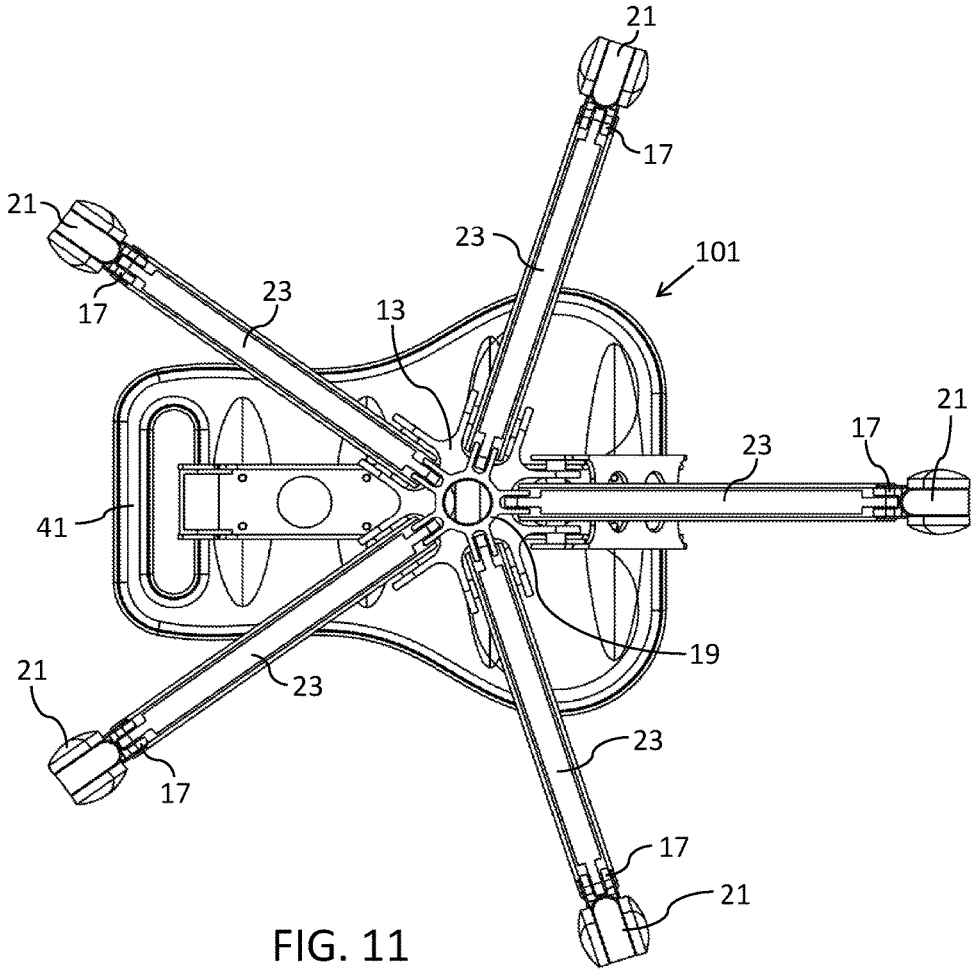
FIG. 11 is a lower plan view of the present invention in an expanded position.
Figure 12:
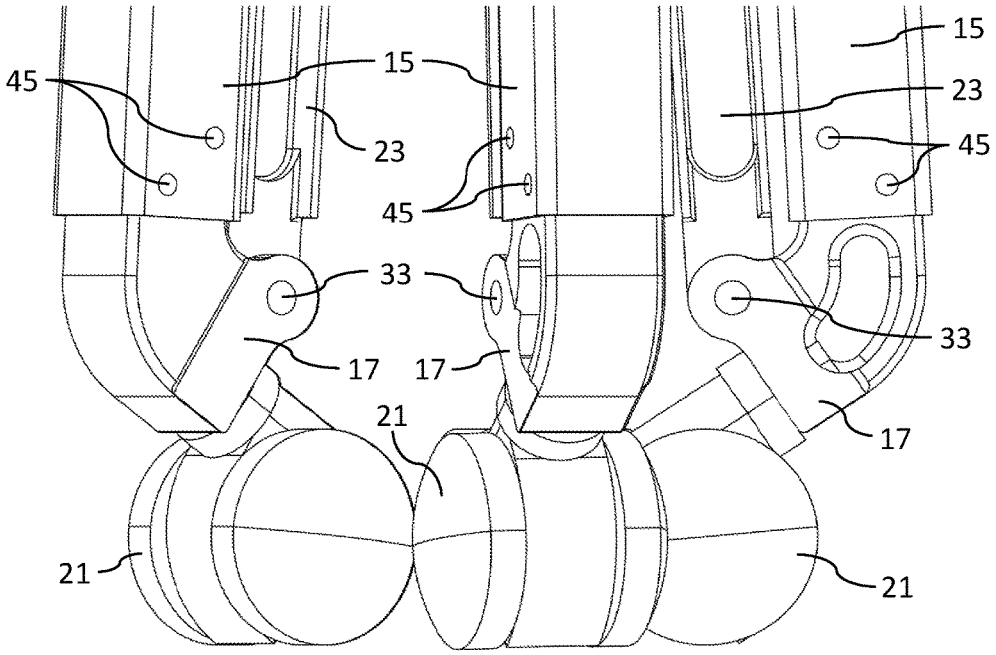
FIG. 12 is a side elevation view of the caster positions of the present invention while sitting on the ground or hanging from its storage guide.

The preferred embodiment of the invention consists of a seat 101, with a handle 41 at its forward end, that is fastened to a seat beam assembly 103, which is connected to a support beam assembly 105 by a hinge that pivots about a seat hinge pin 27. The seat beam assembly 103 contains a storage guide 43 that stabilizes the stool as it rests on a partition, door, or other rigid structure in the collapsed position. A plurality of legs 15, made from hollow aluminum square tubes, are each attached to the lugs of a slider fitting 13 through hinges pivoting about a plurality of leg hinge pins 25 and a lower link hinge pin 35. The legs 15 extend radially and each fasten to a caster fitting 17 with two rivets 45. Each caster fitting 17 attaches a caster 21 with double-wheels to one of the legs 15 by screwing the shank of the caster 21 into a threaded hole. A plurality of tension links 23 connect to each of the caster fittings 17 at hinges connected by a plurality of outer link hinge pins 33. Each of the tension links 23 connect to a single tension fitting 19 by hinging about a plurality of inboard link hinge pins 31 installed into each pair of lugs as part of the tension fitting 19. The tension fitting 19 slides over and is riveted to a support tube 39 that is part of the support assembly 105. The slider fitting 13 contains a center hole large enough to accept a pressed-in bearing of fiber-reinforced plastic with an inner diameter slightly larger than the support tube 39 as to allow vertical movement along the tube. The upmost vertical movement of the slider fitting 13 is restricted by a tube stop 37 welded to the support tube 39. Downward movement of the slider fitting 13 is restricted by the tension fitting 19 or by other restrictions in the system such as caster 21 to caster 21 contact, when collapsed. A main link 11 connects the slider fitting 13 to the seat beam assembly 103 by hinges that pivot about a lower link hinge pin 35 and an upper link hinge pin 29, respectively. The present invention uses sintered bronze plain bearings to support all large hinge pins in the slider fitting 13, main link 11 and seat beam assembly 103. Teflon coated plain bearings are used to support smaller hinge pins connecting the tension links 23. Small pins are retained by applying retaining compound to and pressing them into interference-sized holes in the caster fittings 17 and the tension fitting 19. The preferred embodiment of the present invention uses a seat 101 made of fiber-reinforced plastic, or composite, that contains the handle 41 integral to its structure. The support tube assembly 105 is preferably made of steel with surface treatment or stainless steel. Each of the pins are preferably made from steel or stainless steel. All other parts are preferably made from aluminum.

Figure 15:
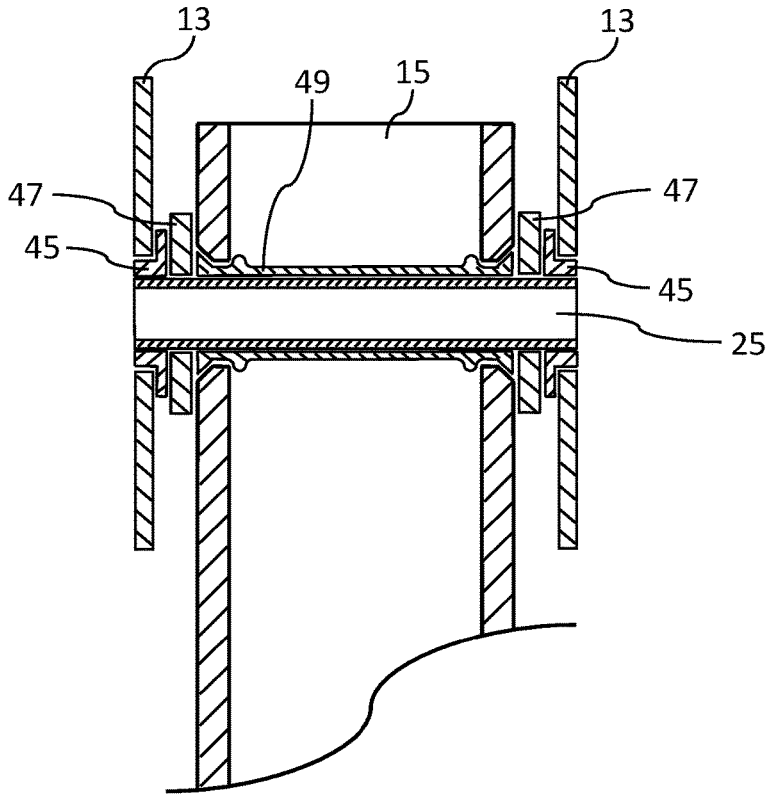
FIG. 15 is a section view illustrating the novel hinge mechanism used to attach each leg of the stool efficiently and without fasteners.

The leg hinge pins 25 are held in place by applying retaining compound and pressing each into the inside of a metal tube 49, preferably made of aluminum, swaged into a through-hole in each of the legs 15. (Refer to FIG. 15) A set of plain bearings 45, preferably made of sintered-bronze, are used as rotational surfaces for each pin, while flat washers 47 are used to bear lateral thrust loads. The upper link hinge pin 29 is coated with retaining compound and pressed through an under-sized tube 51 that retains the pin. The seat hinge pin 27 has retaining compound applied to and is pressed into an interference-sized steel tube that rests in holes of, and tack welded into, the support tube 39 perpendicular to its centerline axis. All large pins, preferably, rotate on sinter-bronze bearings.

An alternate embodiment of the present invention uses a linear roller bearing pressed into, or otherwise captured by, the slider fitting 13 that rides on the support tube 39 made from hardened steel or steel with hardened surface. Each caster 21 may be attached by means threading, or held into the caster fitting 17 by a friction device.

Another embodiment of the present invention uses legs 15 of a different section shape than the preferred square-shape. Tension links 23 could also be made using a different section shape than the I-shape in the preferred embodiment. All parts could be made from an alternate material such as titanium, aluminum, steel, plastic, fiber-reinforced plastic, plastic, or otherwise. Also, rotational bearings, plain, spherical, roller, ball-type, may or may not be used between each hinge pin and each lug. Hinge pins could be replaced by alternate fasteners such as bolts, rivets or otherwise.

Still another embodiment of the present invention uses a seat 101 of different shape yet contains a handle 41, either integral, as used in the present invention, or attached, as to allow collapse and expansion of the stool using a single hand. The storage guide 43 may also be in a different shape, either integral or affixed, yet function in a similar manner, as to stabilize the stool as it sits on a partition, door, or other rigid structure in the collapsed position.

While the preferred embodiment uses five legs 15 and associated linkages, other embodiments may have fewer or greater legs. While a greater number of legs will increase tip-over stability for a given leg length and geometry, it comes with added complexity and weight.

Figure 13:
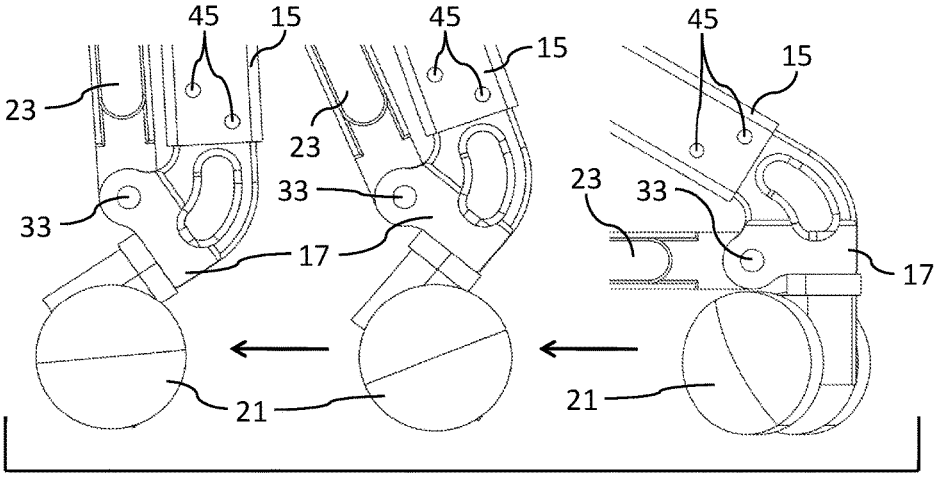
FIG. 13 is a side elevation view illustrating three intermediate caster positions of the present invention as it is being collapsed while still touching the floor.
Figure 14:
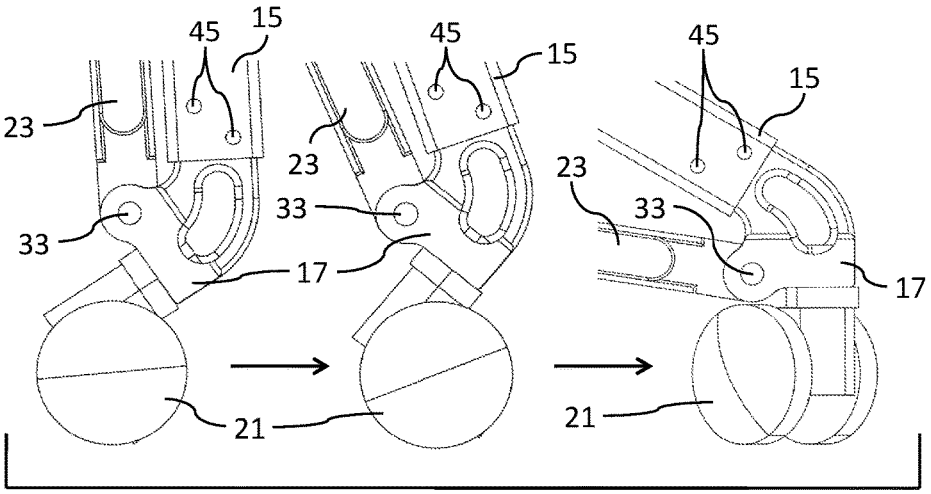
FIG. 14 is a side elevation view illustrating three intermediate caster positions of the present invention as it is being expanded while resting against the floor.

The present invention uses a reciprocating motion of the slider fitting 13 to synchronize the extension and collapse of all five leg 15. The relationship of the slider fitting 13 to the tension fitting 19 along the length of the support assembly 105 determines the positions of the legs 15 and tension links 23. When the legs 15 of the stool are fully extended, the slider fitting 13 rests against the tube stop 37 and the seat 101 is in a horizontal position. The main link 11 connects the seat beam assembly 103 to the slider fitting 37 and synchronizes the rotational motion of the seat 101 to the extension of the leg 15 and supporting structure. To collapse the stool, the handle 41 is raised, simultaneously breaking down the leg support trust structure and raising the seat. As the front of the seat 41 is raised, weight of the stool is still resting on the casters 21. As the legs 15 are drawn inward, the casters 21 rotate so that they trail radially outward. (Refer to FIG. 13) The caster's pivot axis moves from vertical to somewhere between vertical and horizontal when the leg 15 are fully collapsed. The positions of the casters 21 remain stable from gravity once lifted from the floor. If the stool is place back onto the floor, the casters 21 remain in these positions because of the unique orientation the caster fittings 17 place the casters 21 in. Even with the caster pivot axis above the contact points of the wheels to the floor, the casters 21 remain in position, supporting the weight of the stool in the collapsed position. If slight downward pressure is applied to the stool's handle 41, the legs 15 of the stool will extend outward, yet the casters 21 will remain in the same radial position and support the weight of the stool as its legs 15 are being extended. Only when the legs 15 are almost fully expanded and the tension links 23 are near horizontal, will the casters 21 begin to flip around seamlessly. (Refer to FIG. 14) This novel mechanism allows for a smooth transition from collapsed to expanded and expanded to collapsed configurations of the stool. It also allows the stool to be placed on the floor in the collapsed position while supporting its own weight.

Another embodiment of the present invention may arrange the linkages so that contact points of each caster 21 to the ground, while in the collapsed stool position, are radially outboard from the center's of the leg hinge pins 25 and 35. This will allow the stool to unfold as it is placed on the floor without downward pressure on the handle 41. The stool will then be required to hang by the storage guide 43 when not in use.

Figure 16:
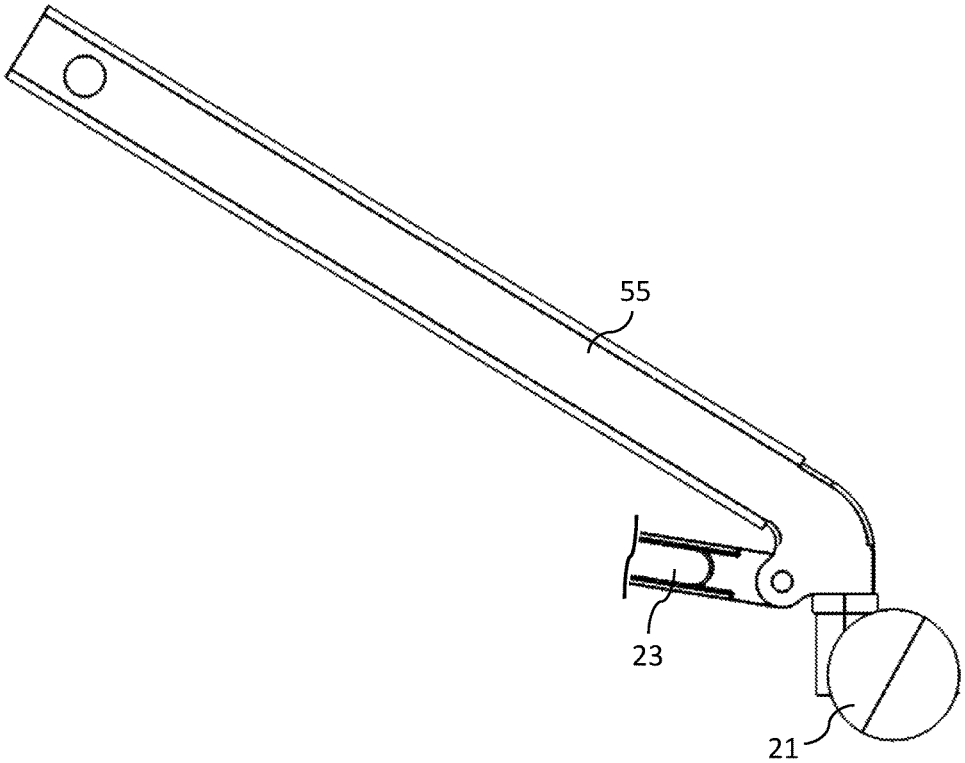
FIG. 16 is a side elevation view of an alternate embodiment of the present invention wherein the legs and caster fittings are a single piece.
Figure 17:
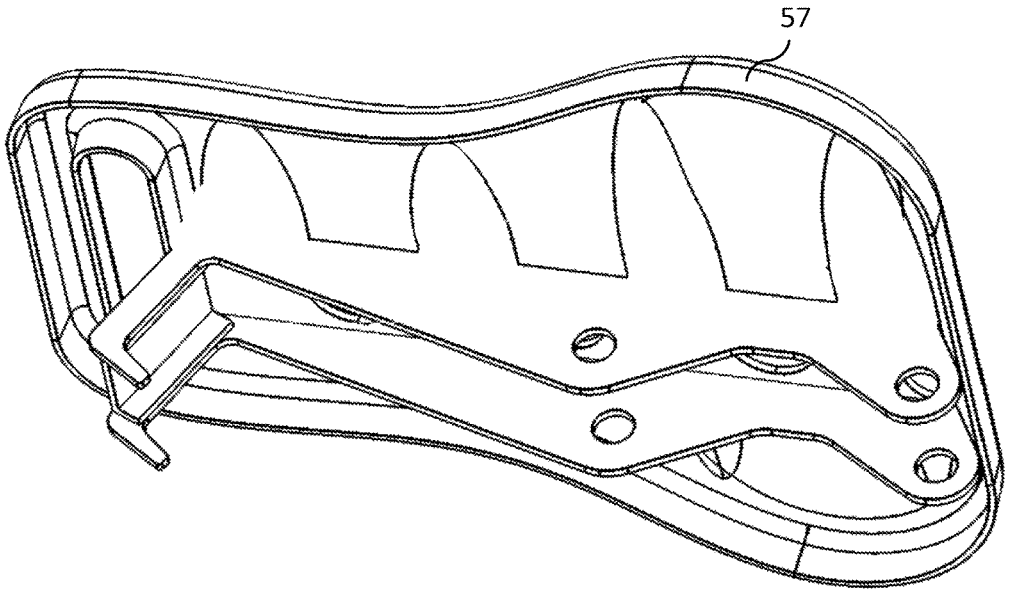
FIG. 17 is a side elevation view of an alternate embodiment of the present invention wherein the seat beam assembly is integral to the seat.

Another embodiment of the present invention combines each leg 15 with a caster fitting 17 to reduce the number of parts. This leg assembly 55 is illustrated in FIG. 16. This embodiment or a different embodiment combines the seat beam assembly 103 with the seat 101. This seat structure assembly 57 is illustrated in FIG. 17.

The forgoing is considered as illustrative only to the principal of the invention. Further, since numerous changes and modification will occur to those skilled in the art, it is not desired to limit the invention to the exact construction and operation shown and described above, and accordingly, all suitable modifications and equivalents may be resorted to falling within the scope of the invention.

What is claimed is:

1. A collapsible stool, comprising:

a. a slider fitting made of rigid material;

b. a plurality of legs attached to said slider fitting each by a hinge that allows said legs to hang downward when collapsed and radially outward and downward when extended;

c. a seat with a sitting surface with a horizontal orientation when said plurality of legs are extended, and said sitting surface is angled away from said horizontal orientation when said plurality of legs are collapsed;

d. a seat beam assembly rigidly attached to said seat;

f. a support assembly containing a support tube as means to support a sitting person;

g. said support assembly is connected at one end to said seat beam assembly using a hinge which allows a rotational motion of the seat beam assembly;

h. said slider fitting straddles said support tube in a manner which allows a linear motion of said slider fitting along said support tube;

i. a plurality of caster fittings each attached to said legs on ends not attached to said slider fitting;

j. a plurality of casters, each containing two or more wheels, each said caster affixed to said caster fittings;

k. a tension fitting attached to lower end of said support assembly made of rigid material;

l. a plurality a tension links made of rigid material each with one end attached to said tension fitting using a hinge and each other end of said tension links are attached to one of said caster fittings using a hinge;

m. a main link with one end attached to said slider fitting and the other end attached to said seat beam assembly to synchronize said rotational motion of said seat on said support assembly to said linear motion of said slider fitting along said support tube.

2. A collapsible stool of claim 1, wherein said legs and said caster fittings are a single niece.

3. A collapsible stool of claim 1, wherein said seat beam assembly is integral to said seat.

4. A collapsible stool of claim 1, further including a storage guide as means for resting said stool on cubical partition, door, or other rigid structure in stable manner when said stool is collapsed.

* * * * *